US011859476B2

(12) United States Patent
Al-Mousa

(10) Patent No.: US 11,859,476 B2
(45) Date of Patent: Jan. 2, 2024

(54) ACCESSIBILITY BELOW AN ELECTRIC SUBMERSIBLE PUMP USING A Y-TOOL

(71) Applicant: SAUDI ARABIAN OIL COMPANY, Dhahran (SA)

(72) Inventor: Ahmed Al-Mousa, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 210 days.

(21) Appl. No.: 17/490,971

(22) Filed: Sep. 30, 2021

(65) Prior Publication Data

US 2023/0099319 A1 Mar. 30, 2023

(51) Int. Cl.
*E21B 43/12* (2006.01)
*E21B 23/06* (2006.01)

(52) U.S. Cl.
CPC ..... *E21B 43/128* (2013.01); *E21B 23/06* (2013.01)

(58) Field of Classification Search
CPC ..... E21B 43/128; E21B 17/07; E21B 23/004
See application file for complete search history.

(56) References Cited

U.S. PATENT DOCUMENTS 6,079,491 A * 6/2000 Stuebinger ..... E21B 43/121 166/266
6,508,308 B1 1/2003 Shaw
7,231,978 B2 * 6/2007 Rivas ..... E21B 43/128 166/305.1
9,181,785 B2 11/2015 Lawson et al.
10,844,699 B2 11/2020 Xiao et al.

FOREIGN PATENT DOCUMENTS

GB 2430701 A 4/2007
GB 2583005 A 10/2020

* cited by examiner

*Primary Examiner* — Cathleen R Hutchins
(74) *Attorney, Agent, or Firm* — Osba Bergman Watanabe & Burton LLP

(57) ABSTRACT

A system includes production tubing, a telescoping joint, a pump sub, a lock ring, and a crossover. The production tubing provides a hydraulic connection from a surface location to a well. The telescoping joint has a housing and a by-pass hanger having a head. An opening of the housing is larger than the by-pass hanger and smaller than the head and the head is moveably located within the housing. The lock ring is disposed around the by-pass hanger directly beneath the opening of the housing. The lock ring absorbs a compressive force and prevents the by-pass hanger from moving in an upwards direction. The crossover component is hydraulically connected to the production tubing and provides the hydraulic connection to the telescoping joint and the pump sub. The pump sub is located parallel to the telescoping joint, and the pump sub is connected to an electric submersible pump string.

20 Claims, 4 Drawing Sheets

ACCESSIBILITY BELOW AN ELECTRIC SUBMERSIBLE PUMP USING A Y-TOOL

BACKGROUND

Hydrocarbon fluids are often found in hydrocarbon reservoirs located in porous rock formations far below the Earth's surface. Wells may be drilled to extract the hydrocarbon fluids from the hydrocarbon reservoirs. Most wells have a variation of downhole equipment, such as Electrical Submersible Pump (ESP) systems, installed to help with the production of hydrocarbons. Once the ESP system is installed in the well, there is no way to access the main bore and any lateral bores without completely removing the ESP as through-tubing tools are unable to pass through the inside of the ESP.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

The present invention presents, in accordance with one or more embodiments, a system and a method for a well completed with an electric submersible pump string. The system includes production tubing, a telescoping joint, a pump sub, a lock ring, and a crossover. The production tubing provides a hydraulic connection from a surface location to the well. The telescoping joint has a housing and a by-pass hanger having a head. An opening of the housing is larger than the by-pass hanger and smaller than the head and the head is moveably located within the housing. The lock ring is disposed around the by-pass hanger directly beneath the opening of the housing. The lock ring absorbs a compressive force and prevents the by-pass hanger from moving in an upwards direction. The crossover component is hydraulically connected to the production tubing and provides the hydraulic connection to the telescoping joint and the pump sub. The pump sub is located parallel to the telescoping joint, and the pump sub is connected to the electric submersible pump string.

The method includes installing an electric submersible pump string, on production tubing, within the well, running a through-tubing tool through the production tubing, and by-passing the electric submersible pump string using a Y-tool to access a section of the well located below the electric submersible pump string. The Y-tool includes a telescoping joint, a lock ring, a pump sub, and a crossover. The telescoping joint has a housing and a by-pass hanger having a head. An opening of the housing is larger than the by-pass hanger and smaller than the head and the head is moveably located within the housing. The lock ring is disposed around the by-pass hanger directly beneath the opening of the housing. The lock ring absorbs a compressive force and prevents the by-pass hanger from moving in an upwards direction. The crossover component is hydraulically connected to the production tubing and provides a hydraulic connection to the telescoping joint and the pump sub. The pump sub is located parallel to the telescoping joint, and the pump sub is connected to the electric submersible pump string.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
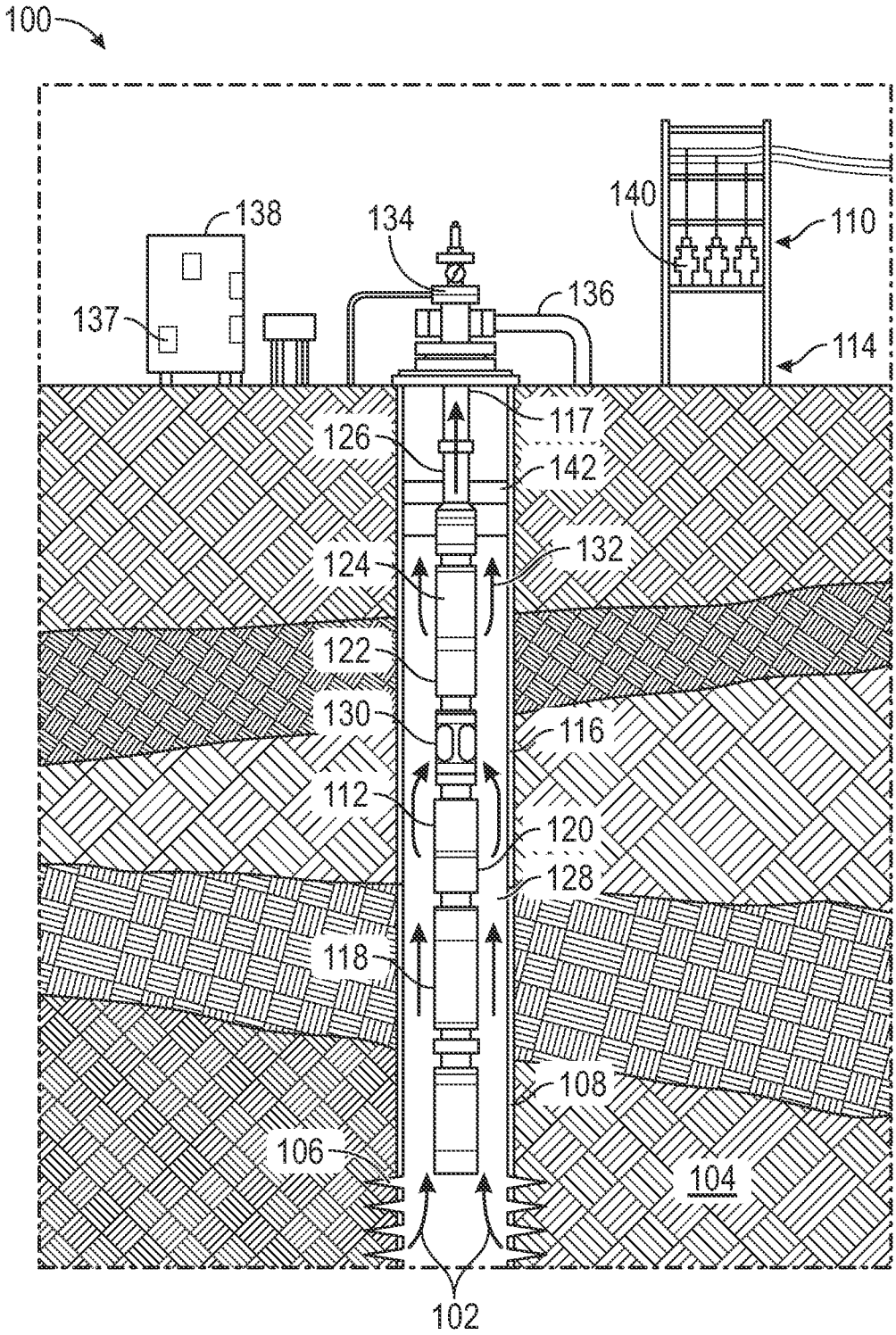
FIG. 1 shows an exemplary Electric Submersible Pump (ESP) system in accordance with one or more embodiments.

FIG. 1 shows an exemplary ESP system (100) in accordance with one or more embodiments. The ESP system (100) is used to help produce produced fluids (102) from a formation (104). Perforations (106) in the well's (116) casing (108) provide a conduit for the produced fluids (102) to enter the well (116) from the formation (104). The ESP system (100) includes a surface portion having surface equipment (110) and a downhole portion having an ESP string (112). The ESP string (112) is deployed in a well (116) on production tubing (117) and the surface equipment (110) is located on a surface location (114). The surface location (114) is any location outside of the well (116), such as the Earth's surface. The production tubing (117) extends to the surface location (114) and is made of a plurality of tubulars connected together to provide a conduit for produced fluids (102) to migrate to the surface location (114).

The ESP string (112) may include a motor (118), motor protectors (120), a gas separator (122), a multi-stage centrifugal pump (124) (herein called a "pump" (124)), and a power cable (126). The ESP string (112) may also include various pipe segments of different lengths to connect the components of the ESP string (112). The motor (118) is a downhole submersible motor (118) that provides power to the pump (124). The motor (118) may be a two-pole, three-phase, squirrel-cage induction electric motor (118). The motor's (118) operating voltages, currents, and horsepower ratings may change depending on the requirements of the operation.

The size of the motor (118) is dictated by the amount of power that the pump (124) requires to lift an estimated volume of produced fluids (102) from the bottom of the well (116) to the surface location (114). The motor (118) is cooled by the produced fluids (102) passing over the motor (118) housing. The motor (118) is powered by the power cable (126). The power cable (126) is an electrically conductive cable that is capable of transferring information. The power cable (126) transfers energy from the surface equipment (110) to the motor (118). The power cable (126) may be a three-phase electric cable that is specially designed for downhole environments. The power cable (126) may be clamped to the ESP string (112) in order to limit power cable (126) movement in the well (116).

Motor protectors (120) are located above (i.e., closer to the surface location (114)) the motor (118) in the ESP string (112). The motor protectors (120) are a seal section that houses a thrust bearing. The thrust bearing accommodates axial thrust from the pump (124) such that the motor (118) is protected from axial thrust. The seals isolate the motor (118) from produced fluids (102). The seals further equalize the pressure in the annulus (128) with the pressure in the motor (118). The annulus (128) is the space in the well (116) between the casing (108) and the ESP string (112). The pump intake (130) is the section of the ESP string (112) where the produced fluids (102) enter the ESP string (112) from the annulus (128).

The pump intake (130) is located above the motor protectors (120) and below the pump (124). The depth of the pump intake (130) is designed based off of the formation (104) pressure, estimated height of produced fluids (102) in the annulus (128), and optimization of pump (124) performance. If the produced fluids (102) have associated gas, then a gas separator (122) may be installed in the ESP string (112) above the pump intake (130) but below the pump (124). The gas separator (122) removes the gas from the produced fluids (102) and injects the gas (depicted as separated gas (132) in FIG. 1) into the annulus (128). If the volume of gas exceeds a designated limit, a gas handling device may be installed below the gas separator (122) and above the pump intake (130).

The pump (124) is located above the gas separator (122) and lifts the produced fluids (102) to the surface location (114). The pump (124) has a plurality of stages that are stacked upon one another. Each stage contains a rotating impeller and stationary diffuser. As the produced fluids (102) enter each stage, the produced fluids (102) pass through the rotating impeller to be centrifuged radially outward gaining energy in the form of velocity. The produced fluids (102) enter the diffuser, and the velocity is converted into pressure. As the produced fluids (102) pass through each stage, the pressure continually increases until the produced fluids (102) obtain the designated discharge pressure and has sufficient energy to flow to the surface location (114).

A packer (142) is disposed around the ESP string (112). Specifically, the packer (142) is located above (i.e., closer to the surface location (114)) the multi-stage centrifugal pump (124). The packer (142) may be any packer (142) known in the art such as a mechanical packer (142). The packer (142) seals the annulus (128) space located between the ESP string (112) and the casing (108). This prevents the produced fluids (102) from migrating past the packer (142) in the annulus (128).

In other embodiments, sensors may be installed in various locations along the ESP string (112) to gather downhole data such as pump intake volumes, discharge pressures, and temperatures. The number of stages is determined prior to installation based of the estimated required discharge pressure. Over time, the formation (104) pressure may decrease and the height of the produced fluids (102) in the annulus (128) may decrease. In these cases, the ESP string (112) may be removed and resized. Once the produced fluids (102) reach the surface location (114), the produced fluids (102) flow through the wellhead (134) into production equipment (136). The production equipment (136) may be any equipment that can gather or transport the produced fluids (102) such as a pipeline or a tank.

The remainder of the ESP system (100) includes various surface equipment (110) such as electric drives (137) and pump control equipment (138) as well as an electric power supply (140). The electric power supply (140) provides energy to the motor (118) through the power cable (126). The electric power supply (140) may be a commercial power distribution system or a portable power source such as a generator.

The pump control equipment (138) is made up of an assortment of intelligent unit-programmable controllers and drives which maintain the proper flow of electricity to the motor (118) such as fixed-frequency switchboards, soft-start controllers, and variable speed controllers. The electric drives (137) may be variable speed drives which read the downhole data, recorded by the sensors, and may scale back or ramp up the motor (118) speed to optimize the pump (124) efficiency and production rate. The electric drives (137) allow the pump (124) to operate continuously and intermittently or be shut-off in the event of an operational problem.

For many ESP completion systems, such as the ESP system (100) depicted in FIG. 1, there is no way to access the portion of the well (116) located beneath (i.e., further away from the surface location (114)) the ESP string (112) without completely removing the ESP string (112). Therefore, systems that allow through-tubing access to the portion of the well (116) located beneath the ESP string (112) are beneficial. As such, embodiments presented herein disclose a Y-tool that may be used to employ a bypass tubing that provides a conduit for a through-tubing tool to by-pass the ESP string (112) and access deeper portions of the well (116).

Figure 2:
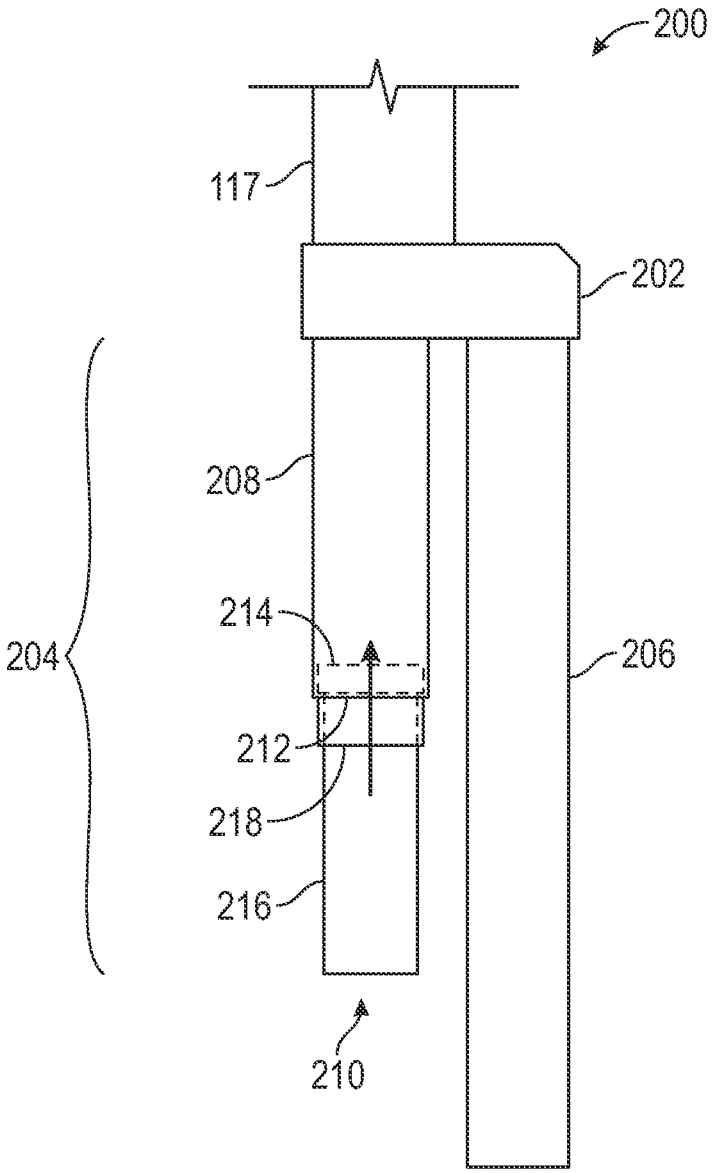
FIG. 2 shows a Y-tool in accordance with one or more embodiments.

FIG. 2 shows a Y-tool (200) in accordance with one or more embodiments. The Y-tool (200) includes a crossover (202), a telescoping joint (204), and a pump sub (206). The crossover (202) of the Y-tool is a tubular that is hydraulically connected to production tubing (117). The production tubing (117) extends to the surface location (114). The production tubing (117) provides a hydraulic connection from the surface location (114) to a depth in the well (116). The crossover (202) is physically connected to the production tubing (117) by any means in the art such as by a threaded connection.

The crossover (202) provides the hydraulic connection from the production tubing (117) to the telescoping joint (204) and the pump sub (206). The telescoping joint (204) and the pump sub (206) may be hydraulically and physically connected to the crossover (202) but not to one another. The telescoping joint (204) and the pump sub (206) may be parallel to one another once each are connected to the crossover (202). The telescoping joint (204) and the pump sub (206) are physically connected to the crossover (202) by any means known in the art such as by a threaded connection.

The pump sub (206) is a tubular that may be similar to the tubulars that make up the production tubing (117). The pump sub (206) may be connected to the crossover (202) and an ESP string (112), such as the ESP string (112) depicted in FIG. 1. The crossover (202) and the ESP string (112) may be connected on opposite ends of the pump sub (206) from one another. The telescoping joint (204) includes a housing (208) and a by-pass hanger (210). The housing (208) is a tubular connected to the crossover (202) on one end and having an opening (212) on the opposite end. The by-pass hanger (210) is also a tubular having a head (214) and a body (216). In one or more embodiments, the by-pass hanger (210) may have an outer diameter of 3.5 inches and an inner diameter of 2.992 inches. The by-pass hanger (210) may be made of steel having a grade of T95.

The housing (208) is hydraulically connected to the crossover (202) and the by-pass hanger (210) is hydraulically connected to the housing (208). The opening (212) of the housing (208) is larger than the body (216) of the by-pass hanger (210) yet smaller than the head (214) of the by-pass hanger (210). The head (214) of the by-pass hanger (210) is moveably located within the inside of the housing (208). The head (214) is moveable within the housing (208) such that the head (214), along with the body (216) of the by-pass hanger (210), may move up and down within the housing (208) (up referring to the direction towards the crossover (202) and down referring to the direction away from the crossover (202)). Because the head (214) is larger than the opening (212) of the housing (208), the head (214) may not exit the housing (208) thus the by-pass hanger (210) is moveably connected to the housing (208).

A lock ring (218) may be disposed around an external circumferential surface of the body (216) of the by-pass hanger (210). The lock ring (218) may be directly beneath the opening (212) when the by-pass hanger (210) is fully extended (fully extended meaning that the head (214) of the by-pass hanger (210) is resting on the opening (212) of the housing (208)). The lock ring (218) absorbs a compressive force and prevents the by-pass hanger (210) from moving in an upwards direction (i.e., in a direction towards the crossover (202)).

Figure 3:
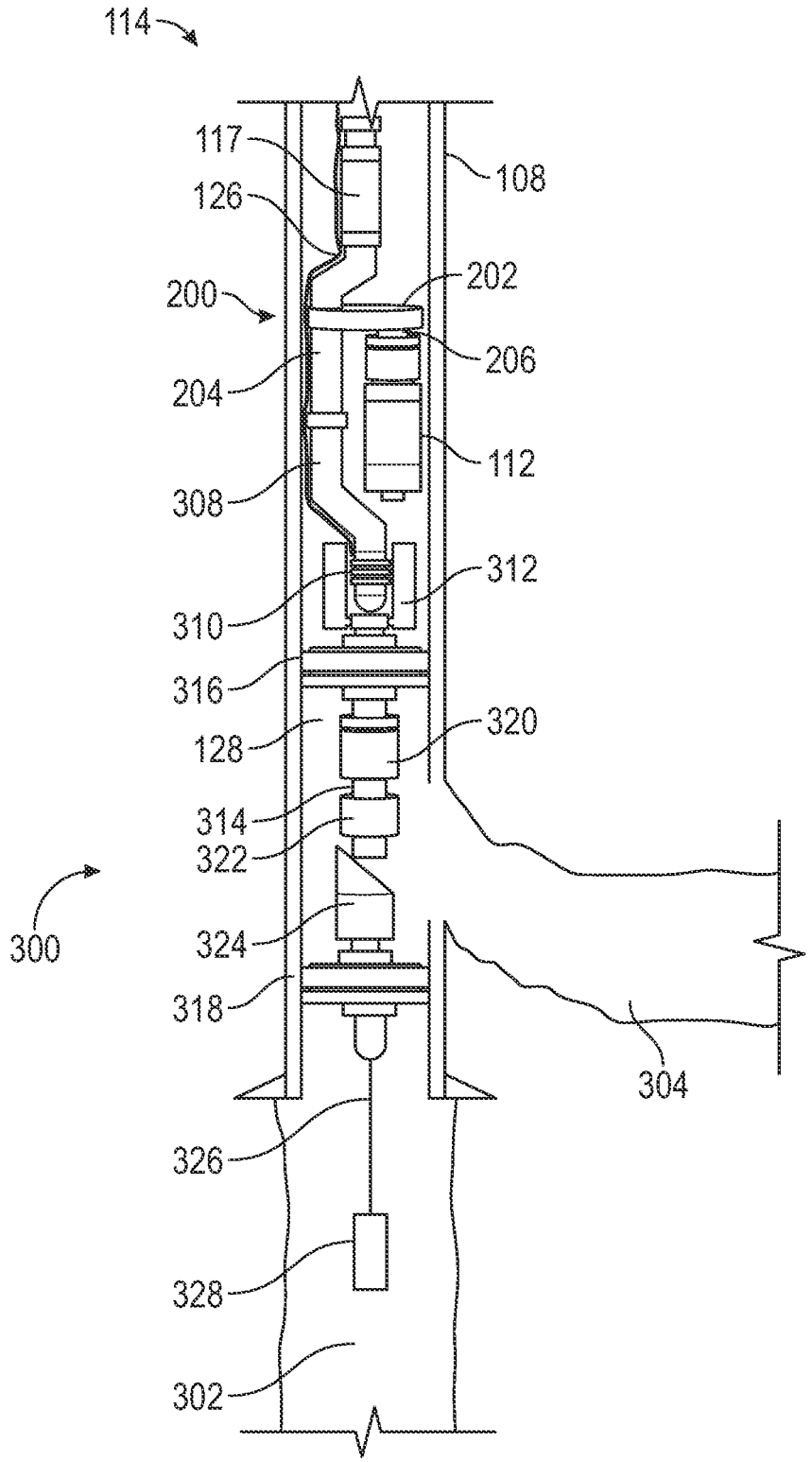
FIG. 3 shows a system incorporating the Y-tool in accordance with one or more embodiments.

FIG. 3 shows a system incorporating the Y-tool (200) in accordance with one or more embodiments. Specifically, FIG. 3 shows a dual bore well (300) using the Y-tool (200), as depicted in FIG. 2, to bypass the ESP string (112), as depicted in FIG. 1. Components shown in FIG. 3 that are the same as or similar to components shown in FIGS. 1 and 2 have not been re-described for purposes of readability and have the same purposes as described above.

The dual bore well (300) has a main bore (302) and a lateral bore (304). The dual bore well (300) has casing (108) that extends from the surface location (114) to a depth downhole. The main bore (302) is a hole drilled into the surface of the Earth. The main bore (302) may be partially covered and supported by the casing (108). The main bore (302) may be a vertically drilled hole. In other embodiments, the main bore (302) is a directional hole drilled at an angle less than 80 degrees from vertical.

The lateral bore (304) is a hole drilled at an angle greater than 80 degrees from vertical. The lateral bore (304) is located above (i.e., closer to the surface location (114)) the main bore (302). In further embodiments, the lateral bore (304) is a horizontal extension of the main bore (302). The casing (108) may end before the beginning of the lateral bore (304). In other embodiments, the lateral bore (304) was sidetracked through the surface of the casing (108) such that the casing (108) extends beneath the beginning of the lateral bore (304) as shown in FIG. 3.

FIG. 3 also shows production tubing (117) located within the casing (108) and extending to the surface location (114). The deepest point of the production tubing (117) (i.e., the end of the production tubing (117) located furthest away from the surface location (114)) is connected to the crossover (202) of the Y-tool (200). The crossover (202) is connected to the telescoping joint (204) and the pump sub (206). The pump sub (206) is connected to the ESP string (112). The by-pass hanger (210) of the telescoping joint (204) is hydraulically and physically connected to by-pass tubing (308). The ESP string (112) may need to be designed with a multi-stage centrifugal pump (124) having a smaller outer diameter than normal in order to fit the telescoping joint (204) and by-pass tubing (308) next to the ESP string (112).

The by-pass tubing (308) is a tubular similar to the tubular of the by-pass hanger (210). The connection between the by-pass tubing (308) and the by-pass hanger (210) is a flush joint connection and may be a threaded connection. The connection between the ESP string (112) and the pump sub (206) may by any connection known in the art such as a threaded connection. The by-pass tubing (308) may be hydraulically and physically connected to a stinger (310). A power cable (126) may extend from the surface location (114), along the production tubing (117) to the stinger (310). The stinger (310) is inserted into a hydraulic-line wet-mate connector (HLWM) (312). The stinger (310) may provide the hydraulic connection between the surface location (114), the main bore (302) and the lateral bore (304). The stinger (310) may have a plurality of seals disposed around the outside of the stinger (310) such that the stinger (310) may create a fluid-tight seal while inserted into the HLWM (312).

The HLWM (312) is connected to a pipe (314). The pipe (314) may be part of a pipe (314) assembly having the HLWM (312), a first packer (316), a second packer (318), a first inflow control valve (ICV) (320), a second ICV (322), and a selective lateral intervention completion (SLIC) (324) system. The pipe (314) may be made out of the same tubular as the production tubing (117). The pipe (314) is hydraulically connected to the main bore (302) and the lateral bore (304). The first packer (316) and the second packer (318) are disposed circumferentially around the pipe (314) and create a seal within the annulus (128) located between the pipe (314) and the casing (108). The first packer (316) and the second packer (318) may be any packer (142) known in the art, such as the packer (142) described in FIG. 1.

The HLWM (312) provides a mechanical, electrical, and hydraulic connection between the stinger (310)/power cable (126) and the pipe (314). The HLWM (312) allows the completion of the dual bore well (300) to be executed in multiple stages. For example, the pipe (314) assembly may be run into the casing (108) prior to the production tubing (117)/ESP string (112) assembly being run into the casing (108). In one or more embodiments, the pipe (314) assembly may be run in the casing (108) on a wireline (326). The first packer (316) and the second packer (318) may be set against the casing (108) allowing the pipe (314) assembly to be held up in the casing (108). The wireline (326) may detach from the pipe (314) assembly leaving the pipe (314) assembly behind. The production tubing (117) may run the ESP string (112)/Y-tool (200) assembly into the casing (108). The stinger (310) may enter or "sting into" the HLWM (312) to connect the pipe (314) assembly hydraulically, mechanically, and electrically to the production tubing (117)/ESP string (112) assembly.

The HLWM (312) is located above (above meaning closer to the surface location (114)) the first packer (316), the first packer (316) is located above the first ICV (320), the first ICV (320) is located above the second ICV (322), the second ICV (322) is located above the SLIC (324) system, and the SLIC (324) system is located above the second packer (318). The first packer (316) is located above the lateral bore (304) yet below the by-pass hanger (210). The second packer (318) is located above the main bore (302) yet beneath the lateral bore (304). The pipe (314) may extend past the second packer (318) and into the main bore (302) such that produced fluids (102) may flow from the main bore (302) into the pipe (314). The first packer (316) prevents produced fluids (102) from migrating up the annulus (128) towards the ESP string (112). The second packer (318) prevents produced fluids (102) from migrating from the main bore (302) to the lateral bore (304).

The first ICV (320) and the second ICV (322) are active components that partially or completely choke flow into the pipe (314) from the main bore (302) and the lateral bore (304). The first ICV (320) and the second ICV (322) may be controlled from the surface location (114) to maintain flow conformance and, as the formation(s) deplete, to stop unwanted produced fluids (102) from entering the pipe (314). A power cable (126) provides electric and hydraulic conduits to relay commands from the surface location (114) to the first ICV (320) and the second ICV (322). Specifically, the first ICV (320) controls a flow of produced fluids (102) from both the lateral bore (304) and the main bore (302). The second ICV (322) controls a flow of produced fluids (102) from the main bore (302).

The SLIC (324) system enables through-tubing intervention in multilateral wells such as the dual bore well (300). The SLIC (324) system may be used to access the lateral bore (304) or to hydraulically isolate the lateral bore (304) from the main bore (302). Multiple SLIC (324) systems can be installed for selective intervention access when a well has multiple lateral bores (304). In one or more embodiments the SLIC (324) system may allow selective through-tubing access to either the lateral bore (304) or the main bore (302). FIG. 3 shows a through-tubing tool (328) run in the dual bore well (300) on the wireline (326). The through-tubing tool (328) may be any type of downhole tool that may be used to perform a workover operation on the main bore (302) or on the lateral bore (304).

Because of the Y-tool (200) and the completion design, as outlined in FIG. 3, the through-tubing tool (328) is able to enter the production tubing (117) at the surface location (114), by-pass the ESP string (112), and enter either the main bore (302) or the lateral bore (304) using the SLIC (324) system. Further, the Y-tool (200), as designed in FIG. 2, is able to both space out the by-pass tubing (308) from the ESP string (112) as they are being run in the casing (108) and absorb the compression force when the stinger (310) is landed out into the HLWM (312).

While FIG. 3 shows the Y-tool (200) being used to by-pass the ESP string (112) in a dual bore well (300) any well such as a well having more than two bores or a well having a singular bore, such as the well (116) depicted in FIG. 1, may be used. Further, the completion scheme of the well may be any completion scheme that includes the Y-tool (200), as described in FIG. 2, to by-pass an ESP string (112) without departing from the scope of this disclosure herein.

Figure 4:
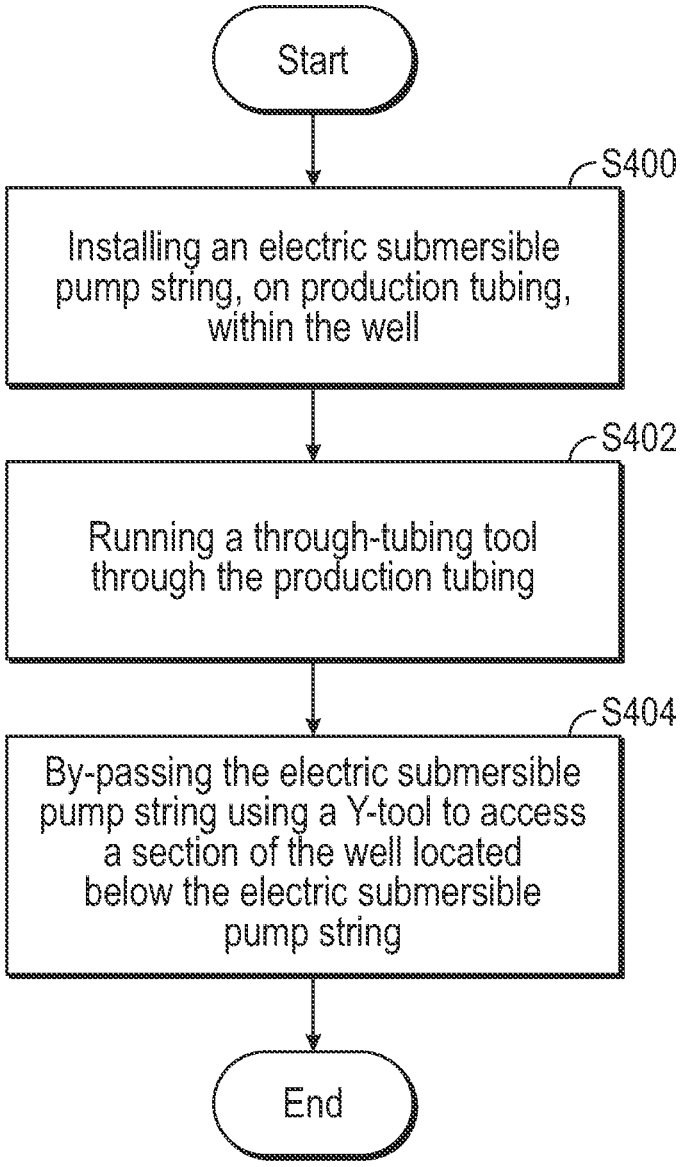
FIG. 4 shows a flowchart in accordance with one or more embodiments.

FIG. 4 shows a flowchart in accordance with one or more embodiments. Specifically, the flowchart illustrates a method for by-passing an ESP string (112) in a dual bore well (300) to access a main bore (302) and a lateral bore (304). Further, one or more blocks in FIG. 4 may be performed by one or more components as described in FIGS. 1-3. While the various blocks in FIG. 4 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, an ESP string (112) is installed on production tubing (117) within a well (S400). The ESP string (112) may be the ESP string (112) as depicted in FIG. 1. The well may be a dual bore well (300) having a main bore (302) and a lateral bore (304) as depicted in FIG. 3. The production tubing (117) extends from a surface location (114) to a depth within the dual bore well (300). The ESP string (112) may be installed to a pump sub (206) of a Y-tool (200), such as the Y-tool depicted in FIG. 2. The Y-tool (200) may be connected to the production tubing (117) through the Y-tool's (200) crossover (202). By-pass tubing (308) may be installed on the telescoping joint (204) of the Y-tool (200).

Installing the ESP string (112) in the dual bore well (300) may include running a pipe (314) assembly, as depicted in FIG. 3, into the dual bore well (300) on wireline (326). The pipe (314) assembly may have a HLWM (312), a first packer (316), a second packer (318), a first ICV (320), a second ICV (322), and a SLIC (324) system (all installed onto the pipe (314)). The pipe (314) assembly may be hydraulically connected to the main bore (302) and the lateral bore (304). The HLWM (312) may be hydraulically connected to the pipe (314). The second packer (318) may be set within the casing (108) above the main bore (302) and below the lateral bore (304). The first packer (316) may be set above the lateral bore (304).

After the first packer (316) and the second packer (318) are set, the ESP string (112) may be run in the dual bore well (300) on the production tubing (117). The telescoping joint (204) allows the by-pass tubing (308) to be spaced out from the ESP string (112) as they are being run into the dual bore well (300). A stinger (310), connected to the by-pass tubing (308), may be inserted into the HLWM (312) to create a hydraulic connection between the lateral bore (304), the main bore (302), and the surface location (114). The insertion of the stinger (310) into the HLWM (312) also creates a mechanical and electrical connection between the surface location (114) and the pipe (314) assembly.

As the stinger (310) is inserted into the HLWM (312), a compressive force is transferred to the stinger (310), to the by-pass tubing (308), and to the by-pass hanger (210). The compressive force is absorbed by the lock ring (218), thus preventing the compressive force from being transferred to the ESP string (112). If the compressive force were to be transferred to the ESP string (112), the motor (118) and the multi-stage centrifugal pump (124) of the ESP string (112) may fail.

Upon insertion of the stinger (310) into the HLWM (312), the dual bore well may be placed on production. Over the life of the dual bore well (300), a workover operation may need to be performed. During the workover operation, a through-tubing tool (328) is run through the production tubing (117) (S402). The through-tubing tool (328) is able to by-pass the ESP string (112) using the Y-tool (200) to access a section of the well located below the ESP string (112) (S404). Specifically, the through-tubing tool (328) may enter the production tubing (117) at the surface location (114). The through-tubing tool (328) may be run on wireline (326). The through-tubing tool (328) may be run through the crossover, the by-pass hanger, and the by-pass tubing (308) to by-pass the ESP string (112). The through-tubing tool (328) may enter either the lateral bore (304) or the main bore (302) using the SLIC (324) system.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A system for a well completed with an electric submersible pump string, the system comprising:

production tubing providing a hydraulic connection from a surface location to the well;

a telescoping joint comprising a housing and a by-pass hanger having a head, wherein an opening of the housing is larger than the by-pass hanger and smaller than the head and the head is moveably located within the housing;

a lock ring disposed around the by-pass hanger directly beneath the opening of the housing, wherein the lock ring absorbs a compressive force and prevents the by-pass hanger from moving in an upwards direction; and a crossover component hydraulically connected to the production tubing and providing the hydraulic connection to the telescoping joint and a pump sub, wherein the pump sub is located parallel to the telescoping joint, and the pump sub is connected to the electric submersible pump string.

2. The system of claim 1, wherein the well comprises a main bore and a lateral bore.

3. The system of claim 2, further comprising:

a first packer fixed within the well and located below the by-pass hanger and above the lateral bore.

4. The system of claim 3, further comprising:

a second packer fixed within the well and located above the main bore and below the lateral bore.

5. The system of claim 4, wherein the first packer and the second packer are connected to one another through a pipe that is hydraulically connected to the main bore and the lateral bore.

6. The system of claim 5, further comprising:

a first inflow control valve fixed along the pipe and configured to control a flow of fluid from the main bore and the lateral bore.

7. The system of claim 6, further comprising:

a second inflow control valve fixed below the first inflow control valve on the pipe and configured to control the flow of fluid from the main bore.

8. The system of claim 7, further comprising:

a stinger hydraulically connected to the by-pass hanger.

9. The system of claim 8, wherein the stinger is connected to a Hydraulic-Line Wet-Mate Connector, connected to the pipe, to provide the hydraulic connection between the surface location, the main bore, and the lateral bore.

10. The system of claim 9, further comprising:

a selective lateral intervention completion system, connected to the pipe, and configured to allow selective through-tubing access to either the lateral bore or the main bore.

11. A method for a well, the method comprising:

installing an electric submersible pump string, on production tubing, within the well;

running a through-tubing tool through the production tubing; and by-passing the electric submersible pump string using a Y-tool to access a section of the well located below the electric submersible pump string, wherein the Y-tool comprises:

a telescoping joint comprising a housing and a by-pass hanger having a head, wherein an opening of the housing is larger than the by-pass hanger and smaller than the head and the head is moveably located within the housing;

a lock ring disposed around the by-pass hanger directly beneath the opening of the housing, wherein the lock ring absorbs a compressive force and prevents the by-pass hanger from moving in an upwards direction; and a crossover component hydraulically connected to the production tubing and providing a hydraulic connection to the telescoping joint and a pump sub, wherein the pump sub is located parallel to the telescoping joint, and the pump sub is connected to the electric submersible pump string.

12. The method of claim 11, wherein the section of the well located below the electric submersible pump string comprises a main bore and a lateral bore.

13. The method of claim 12, wherein installing the electric submersible pump string within the well further comprises setting a first packer within the well below the by-pass hanger and above the lateral bore.

14. The method of claim 13, wherein installing the electric submersible pump string within the well further comprises setting a second packer within the well above the main bore and below the lateral bore.

15. The method of claim 14, wherein the first packer and the second packer are connected to one another through a pipe that is hydraulically connected to the main bore and the lateral bore.

16. The method of claim 15, wherein installing the electric submersible pump string within the well further comprises installing a first inflow control valve, configured to control a flow of fluid from the main bore and the lateral bore, onto the pipe.

17. The method of claim 16, wherein installing the electric submersible pump string within the well further comprises installing a second inflow control valve, configured to control the flow of fluid from the main bore, onto the pipe below the first inflow control valve.

18. The method of claim 17, wherein installing the electric submersible pump string within the well further comprises installing a stinger to the by-pass hanger.

19. The method of claim 18, wherein installing the electric submersible pump string within the well further comprises inserting the stinger into a Hydraulic-Line Wet-Mate Connector connected to the pipe above the first packer.

20. The method of claim 19, wherein installing the electric submersible pump string within the well further comprises installing a selective lateral intervention completion system to the pipe to allow selective through tubing access to either the main bore or the lateral bore.

* * * * *